US011502395B2

(12) United States Patent
Iwasaki et al.

(10) Patent No.: US 11,502,395 B2
(45) Date of Patent: Nov. 15, 2022

(54) ANTENNA DEVICE

(71) Applicant: YOKOWO CO., LTD., Tokyo (JP)

(72) Inventors: Satoshi Iwasaki, Tomioka (JP); Kazuya Matsunaga, Tomioka (JP); Tomohiko Yamase, Tomioka (JP)

(73) Assignee: YOKOWO CO., LTD., Tokyo (JP)

( * ) Notice: Subject to any disclaimer, the term of this patent is extended or adjusted under 35 U.S.C. 154(b) by 0 days.

(21) Appl. No.: 16/637,270

(22) PCT Filed: Oct. 2, 2018

(86) PCT No.: PCT/JP2018/036776
§ 371 (c)(1),
(2) Date: Feb. 7, 2020

(87) PCT Pub. No.: WO2019/073849
PCT Pub. Date: Apr. 18, 2019

(65) Prior Publication Data

US 2020/0251810 A1 Aug. 6, 2020

(30) Foreign Application Priority Data

Oct. 11, 2017 (JP) ..... JP2017-197978

(51) Int. Cl.
*H01Q 1/32* (2006.01)
*H01Q 1/42* (2006.01)
(Continued)

(52) U.S. Cl.
CPC ..... *H01Q 1/3275* (2013.01); *H01Q 1/42* (2013.01); *H01Q 9/32* (2013.01); *H01Q 21/10* (2013.01)

(58) Field of Classification Search
CPC .. H01Q 9/32; H01Q 9/34; H01Q 9/36; H01Q 9/38; H01Q 21/10; H01Q 1/244; H01Q 1/3275; H01Q 5/15
See application file for complete search history.

(56) References Cited

U.S. PATENT DOCUMENTS 6,738,650 B1 5/2004 Zhou et al.
7,170,463 B1 * 1/2007 Seavey ..... H01Q 9/16 343/793
2003/0020660 A1 * 1/2003 Sakurai ..... H01Q 1/244 343/702

FOREIGN PATENT DOCUMENTS

CN 102468529 A 5/2012
DE 201 06 005 U1 8/2001
(Continued)

OTHER PUBLICATIONS

Extended European Search Report dated Jun. 7, 2021 in European Patent Application No. 18866912.1, 9 pages.
(Continued)

*Primary Examiner* — Daniel Munoz
(74) *Attorney, Agent, or Firm* — Xsensus LLP

(57) ABSTRACT

An antenna device includes: an antenna element for vertically polarized waves, having a first straight line portion of which one end serves as a power feeding point, and an annular portion of which one end is connected to another end of the first straight line portion; and a first dielectric cover covering the antenna element from outside. An antenna device includes: an antenna element for vertically polarized waves, having a first straight line portion of which one end serves as a power feeding point, and an annular portion of which one end is connected to another end of the first straight line portion; and a second dielectric cover covering the first straight line portion and the annular portion from outside.

20 Claims, 19 Drawing Sheets

(51) Int. Cl.
*H01Q 9/32* (2006.01)
*H01Q 21/10* (2006.01)

(56) References Cited

FOREIGN PATENT DOCUMENTS

| | | | | | |
|---|---|---|---|---|---|
| JP | 05-022013 | A | | 1/1993 | |
| JP | 2001-185943 | A | | 7/2001 | |
| JP | 2005-175557 | A | | 6/2005 | |
| WO | WO-2010121851 | A1 | * | 10/2010 | ..... H01Q 9/28 |

OTHER PUBLICATIONS

Written Opinion of the International Searching Authority dated Dec. 11, 2018 in PCT/JP2018/036776, 9 pages.
Naohisa GOTO, et al., Handbook of Antennas and Wireless Communications, 1st Edition, Ohmsha, LTD., Oct. 25, 2006, 12 pages.

* cited by examiner

ANTENNA DEVICE

CROSS-REFERENCE TO RELATED APPLICATIONS

The present application is based on PCT filing PCT/JP2018/036776, filed Oct. 2, 2018, which claims priority to JP 2017-197978, filed Oct. 11, 2017, the entire contents of each are incorporated herein by reference.

TECHNICAL FIELD

The present invention relates to an antenna device suitable for use in a vehicle or the like.

BACKGROUND ART

Conventionally, as an omnidirectional antenna, there has been known a collinear array antenna in which a length of a straight line portion is λ/2 and a length of a delay portion is λ/2, for example (see Non Patent Literature 1). However, when such a collinear array antenna is used as an antenna for a vehicle which is required to reduce its height, it is difficult to ensure a sufficient antenna element length, and a gain obtained in a horizontal plane is low.

CITATION LIST

Non Patent Literature

Non Patent Literature 1: Naohisa GOTOH, and two other authors. "Antenna/Wireless Handbook", 1st Edition, Ohm Co., Ltd. October 2006, p. 140

SUMMARY OF INVENTION

Technical Problem

The present invention has been made in view of these circumstances, and an object of the present invention is to improve a horizontal plane gain while maintaining a-non directivity characteristic by bringing a dielectric body close to an antenna element even when it is difficult to ensure a sufficient antenna element length.

Solution to Problem

A first aspect of the present invention is an antenna device. The antenna device includes an antenna element for vertically polarized waves, including a first straight line portion of which one end serves as a power feeding point, and an annular portion of which one end is connected to another end of the first straight line portion, and a first dielectric cover covering the antenna element from outside.

A second aspect of the present invention is an antenna device. The antenna device includes an antenna element for vertically polarized waves, including a first straight line portion of which one end serves as a power feeding point, and an annular portion of which one end is connected to another end of the first straight line portion, and a second dielectric cover covering the first straight line portion and the annular portion from outside.

According to the first aspect, it is preferable that a second dielectric cover covering the first straight line portion and the annular portion from the outside is further included.

According to second aspect, it is preferable that a distance between the antenna element and the second dielectric cover is equal to or less than 0.01 times a wavelength of an operating frequency of the antenna element.

According to the first aspect, it is preferable that the first dielectric cover has a portion facing the first straight line portion substantially in parallel.

According to the first aspect, it is preferable that a distance between the antenna element and the first dielectric cover is equal to or less than 0.04 times a wavelength of an operating frequency of the antenna element.

A third aspect of the present invention is an antenna device. The antenna device includes an antenna element for vertically polarized waves, including a first straight line portion of which one end serves as a power feeding point, and an annular portion of which one end is connected to another end of the first straight line portion, and a dielectric core positioned along the first straight line portion and positioned inside or outside the annular portion.

According to the first or second aspect, it is preferable that a dielectric core positioned along the first straight line portion and positioned inside or outside the annular portion is further included.

According to any one of the first to third aspects, it is preferable that the antenna element is a collinear array antenna in which a second straight line portion is connected to another end of the annular portion and the annular portion serves as a delay portion.

According to any one of the first to third aspects, it is preferable that second straight line portion may include a bent portion at an end portion opposite to one end connected to the annular portion.

A fourth aspect of the present invention is an antenna device. The antenna device includes an antenna element for vertically polarized waves, including a first straight line portion of which one end serves as a power feeding point, and an annular portion of which one end is connected to another end of the first straight line portion, and a third dielectric cover covering at least a part of the antenna element from outside and having an opening at a side of an end portion of the antenna element opposite to the power feeding point, wherein the antenna element extends outside the opening.

According to the fourth aspect, it is preferable that a distance between the antenna element and the third dielectric cover is equal to or less than 0.01 times a wavelength of a working frequency of the antenna element.

Any combinations of the above constituent elements, and expressions of the present invention that are converted in methods and systems are also effective as aspects of the present invention.

Advantageous Effects of Invention

According to the antenna device of the present invention, even in a situation in which it is difficult to ensure a sufficient antenna element length, for example, in an application for a vehicle, it is possible to improve the horizontal plane gain while maintaining the non-directivity characteristic by bringing the dielectric close to the antenna element.

DESCRIPTION OF EMBODIMENTS

Figure 1:
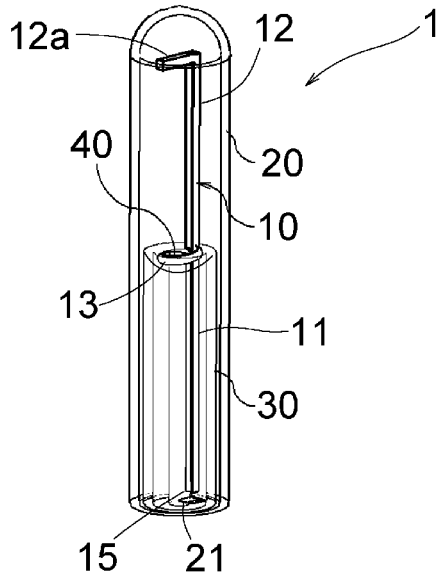
FIG. 1 is a perspective view showing an internal structure of an antenna device according to a first embodiment of the present invention as seen through an outer cover as a first dielectric cover and an inner cover as a second dielectric cover.

Hereinafter, preferred embodiments of the present invention will be described in detail with reference to the drawings. The same or equivalent components, members, processes, or the like illustrated in the drawings are denoted by the same reference numerals, and a repetitive description thereof will be appropriately omitted. In addition, the embodiments are not intended to limit the invention, and all the features and combinations thereof described in the embodiments are not necessarily essential to the invention.

First Embodiment

Figure 2:
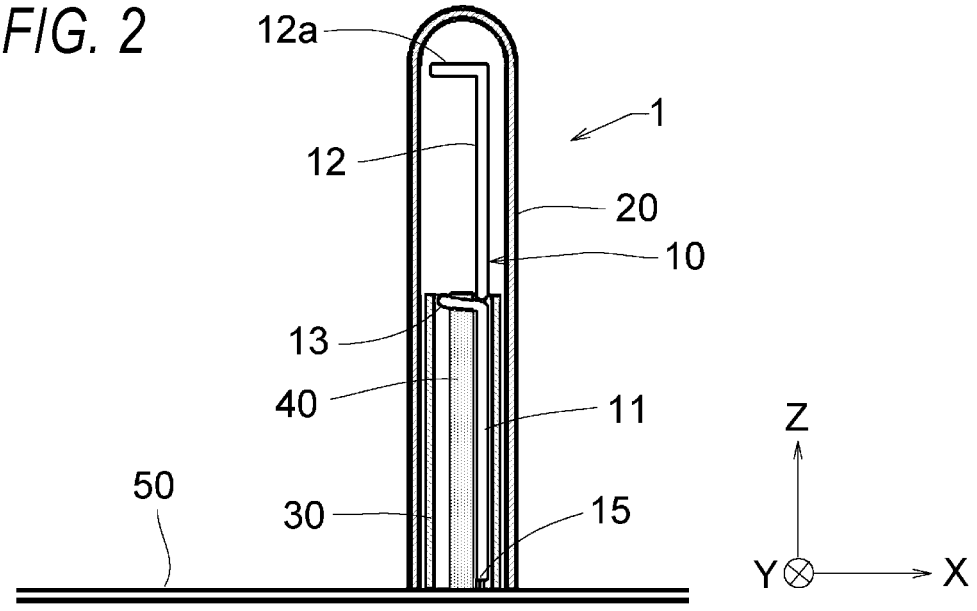
FIG. 2 is a front sectional view of the same.
Figure 3:
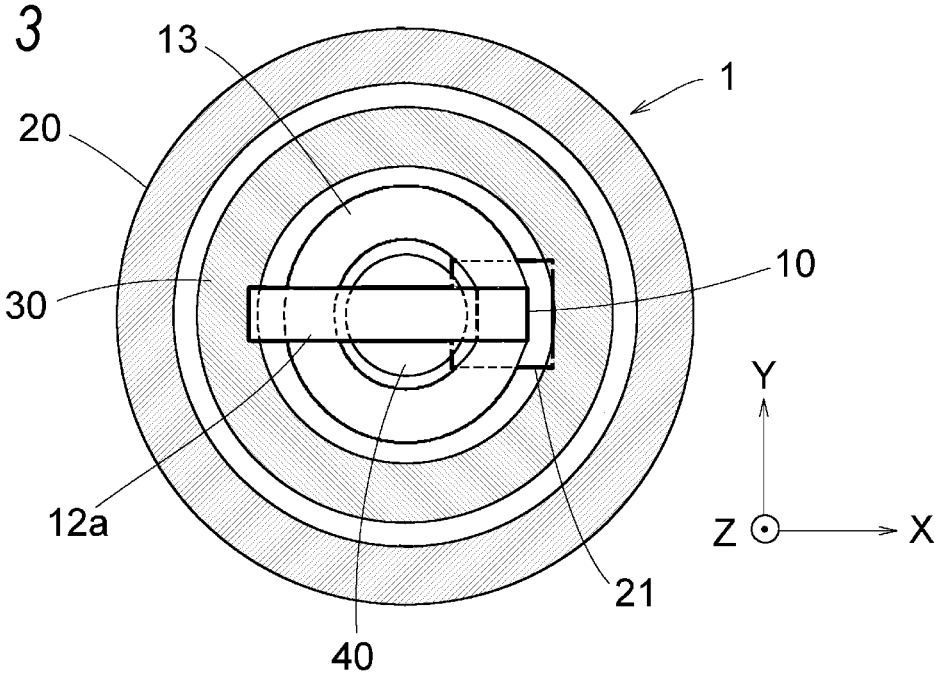
FIG. 3 is an enlarged plan sectional view of the same.
Figure 4:
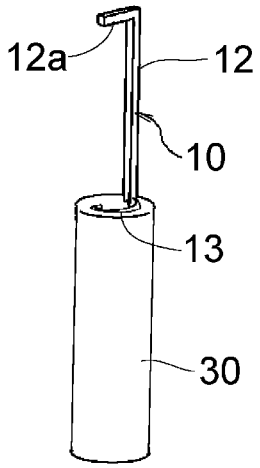
FIG. 4 is a perspective view of the first embodiment in a state that the outer cover as the first dielectric cover is removed.
Figure 5:
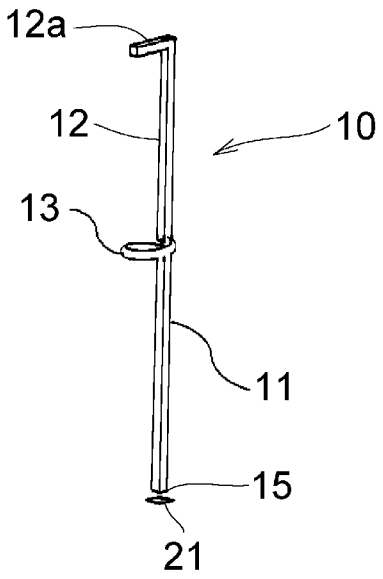
FIG. 5 is a perspective view of a collinear array antenna as an antenna element according to the first embodiment.

FIG. 1 is a perspective view of an antenna device 1 according to a first embodiment of the present invention, FIG. 2 is a front sectional view thereof, and FIG. 3 is an enlarged plan sectional view thereof. FIG. 4 is a perspective view of the first embodiment in which an outer cover 20 as a first dielectric cover is removed from the antenna device 1, and FIG. 5 is a perspective view of a collinear array antenna 10 as an antenna element included in the antenna device 1. The collinear array antenna 10 is used for, for example, V2X (Vehicle to Everything: Vehicle to Vehicle, Road to Vehicle) communication, and a wavelength for use is λ (about 51 mm). In addition, orthogonal X, Y, and Z-axis directions are defined in FIGS. 2 and 3. A ground conductor plate 50 in FIG. 2 is on an XY plane, and a Z axis is perpendicular to the XY plane.

As shown in FIGS. 1 to 5, the antenna device 1 includes the collinear array antenna 10 as an antenna element, an outer cover 20 as a first dielectric cover that entirely covers the collinear array antenna 10 from outside, an inner cover 30 as a second dielectric cover that is arranged inside the outer cover 20, and a dielectric core 40.

As shown in FIG. 5, the collinear array antenna 10 has a first (lower) straight line portion 11 of which one end serves as a power feeding point 15 insulated from the ground conductor plate 50, an annular delay portion 13 of which one end is connected to another end of the first straight line portion 11, and a second (upper) straight line portion 12 connected to another end of the annular delay portion 13. An upper end portion of the second straight line portion 12 is a bent portion 12*a* bent into an inverted L-shape. The annular delay portion 13 has a structure spirally wound for one turn, and is used for phase adjustment between the first straight line portion 11 and the second straight line portion 12. As shown in FIG. 2, the first straight line portion 11 and the second straight line portion 12 are arranged on the ground conductor plate 50 and are on a straight line perpendicular to the ground conductor plate 50 (parallel to the Z axis) except for the bent portion 12*a* of the second straight line portion 12. In a case in which the antenna device 1 is attached to a vehicle body roof, the vehicle body roof functions as the ground conductor plate 50, and the antenna device 1 is arranged substantially perpendicular to (that is, substantially the vertical direction) a horizontal plane (a plane perpendicular to the direction of gravity) so as to be used for vertically polarized waves suitable for the V2X communication. The bent portion 12*a* at the upper end of the second straight line portion 12 is formed to shorten a height of the collinear array antenna 10 in the Z-axis direction. That is, when there is no restriction on the height, the entire second straight line portion 12 may have a straight line shape. However, since the height is required when the entire second straight line portion 12 has the straight line shape, the bent portion 12*a* is provided to reduce the height in the present embodiment. Therefore, when the bent portion 12*a* is extended in the Z-axis direction, the length is the same as when the entire second straight line portion 12 has the straight line shape.

The outer cover 20 is an exterior case that entirely covers the collinear array antenna 10 from the outside. As shown in FIG. 3, a side surface portion of the outer cover 20 surrounds the entire circumference of the collinear array antenna 10 in a cylindrical shape so as to have a portion which face the first straight line portion 11 and the second straight line portion 12 of the collinear array antenna 10 substantially in parallel to the first straight line portion 11 and the second straight line portion 12, and is arranged so as to be concentric with the annular delay portion 13. As shown in FIG. 4, the inner cover 30 has a cylindrical shape which has a length reaching the annular delay portion 13 from a lower end of the collinear array antenna 10, and is arranged so as to be concentric with and in non-contact with the annular delay portion 13 and the outer cover 20. A thickness of the outer cover 20 and a thickness of the inner cover 30 are 0.5 mm (about 0.01λ) The dielectric core 40 has a cylindrical shape which has a length reaching the inside of the annular delay portion 13 from the lower end of the collinear array antenna 10, and is arranged so as to be concentric with and in non-contact with the annular delay portion 13. The outer cover 20 may be provided with a hole 21 for feeding power to the power feeding point 15.

Figure 6:
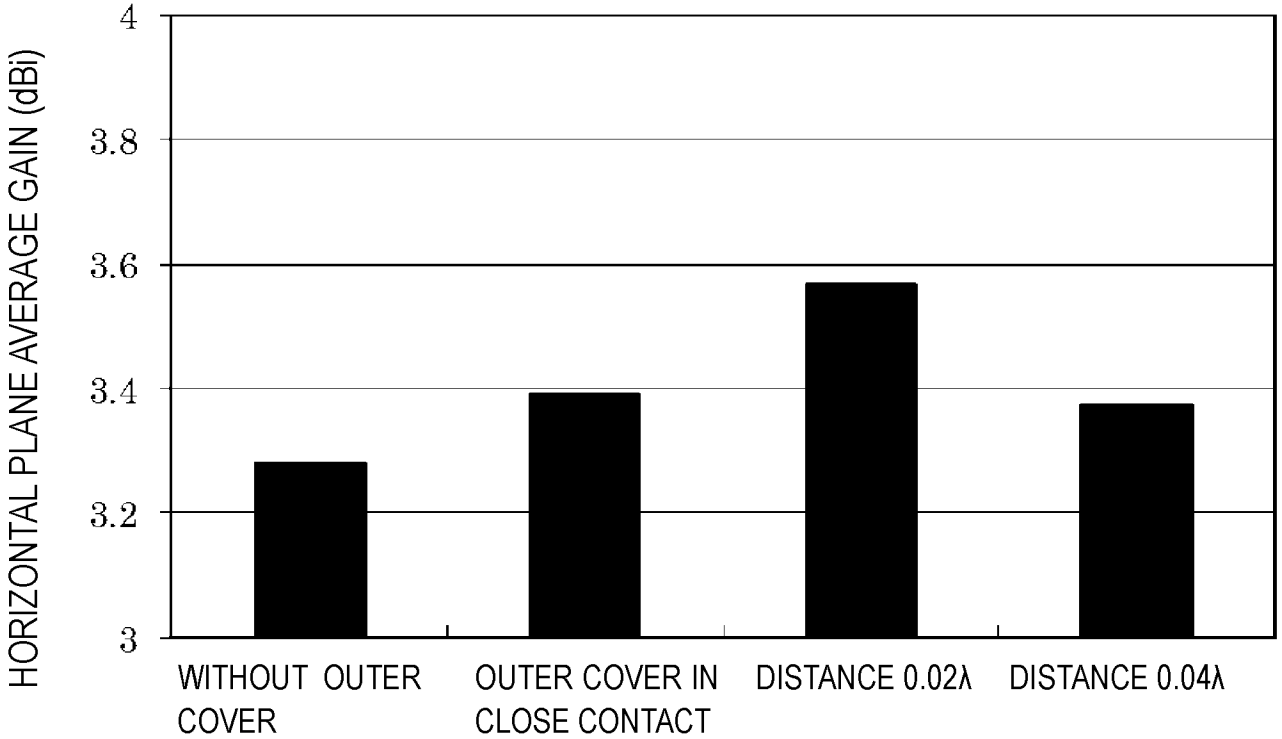
FIG. 6 is an explanatory diagram by simulation showing a relationship between a distance between the outer cover and the collinear array antenna and a horizontal plane average gain (here, the inner cover as the second dielectric cover and a dielectric core are not present), according to the first embodiment.

FIG. 6 is an explanatory diagram by simulation showing a relationship between a distance between the outer cover 20 and the collinear array antenna 10 and a horizontal plane average gain. In this case, the simulation was performed at a wavelength for V2X communication of 51 mm on an assumption that the ground conductor plate 50 on the XY plane was horizontally arranged and the inner cover 30 and the dielectric core 40 were not present. Here, the distance is a clearance between the annular delay portion 13 of the collinear array antenna 10 and the outer cover 20, a distance of 0.02λ corresponds to about 1 mm, and a distance of 0.04λ corresponds to about 2 mm. As shown in FIG. 6, when the outer cover 20 entirely covers the collinear array antenna 10 ("OUTER COVER IS IN CLOSE CONTACT", "DISTANCE 0.02λ", and "DISTANCE 0.04λ"), the horizontal plane average gain is improved as compared with a case in which the outer cover 20 does not cover the entire collinear array antenna 10 ("WITHOUT OUTER COVER"). The reason for this is that there is a premise that the collinear array antenna 10 is limited in the length in the Z-axis direction for the application for the vehicle and a sufficient length cannot be secured, but shortage of the length of the collinear array antenna 10 can be compensated by a wavelength shortening effect due to a dielectric constant of the outer cover 20.

From FIG. 6, it can be easily estimated that the horizontal plane gain decreases as the distance between the outer cover 20 and the collinear array antenna 10 becomes larger than 0.04λ. Therefore, it is desirable to set the distance between the outer cover 20 and the collinear array antenna 10 to be equal to or less than 0.04λ (more preferably 0.02λ or less), so that the horizontal plane gain can be sufficiently improved and a size (height) of the antenna device 1 can be reduced.

Figure 7:
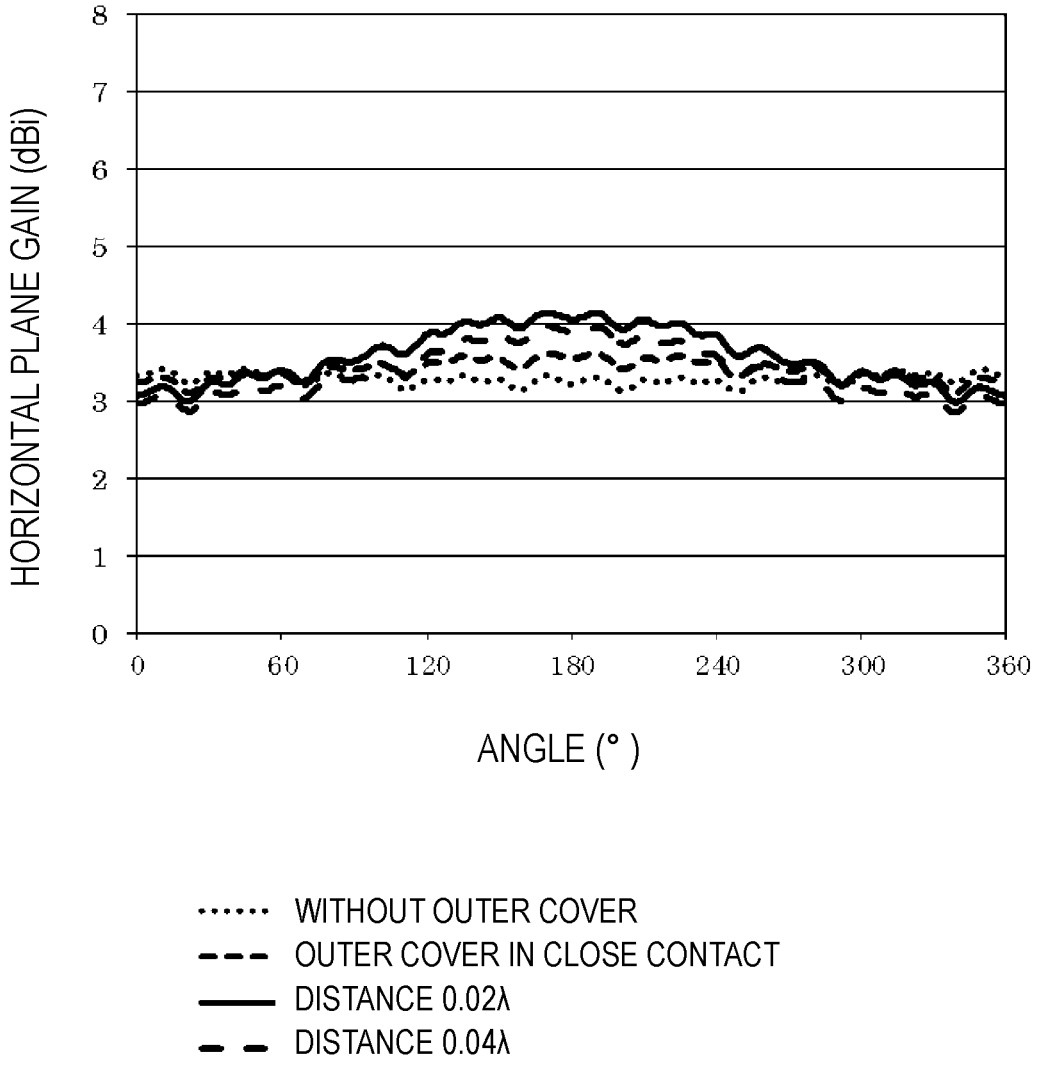
FIG. 7 is also a directional characteristic diagram by simulation showing a relationship between a directional angle and a horizontal plane gain (here, the inner cover and the dielectric core are not present).

FIG. 7 is a directional characteristic diagram by simulation showing a relationship between a directional angle and the horizontal plane gain. A precondition of the simulation is the same as those in FIG. 6. In addition, the directional angle of 180° in FIG. 7 coincides with an X direction in FIG. 3. As shown in FIG. 7, fluctuation of the horizontal plane gain accompanying the change in the directional angle when the entire collinear array antenna 10 is covered with the outer cover 20 ("OUTER COVER IS IN CLOSE CONTACT", "DISTANCE 0.02λ", and "DISTANCE 0.04λ") is not significantly different from the fluctuation of the horizontal plane gain when the collinear array antenna 10 is not entirely covered with the outer cover 20 ("WITHOUT OUTER COVER"), and an omnidirectional property can be substantially maintained even when the entire collinear array antenna 10 is covered with the outer cover 20.

Figure 8:
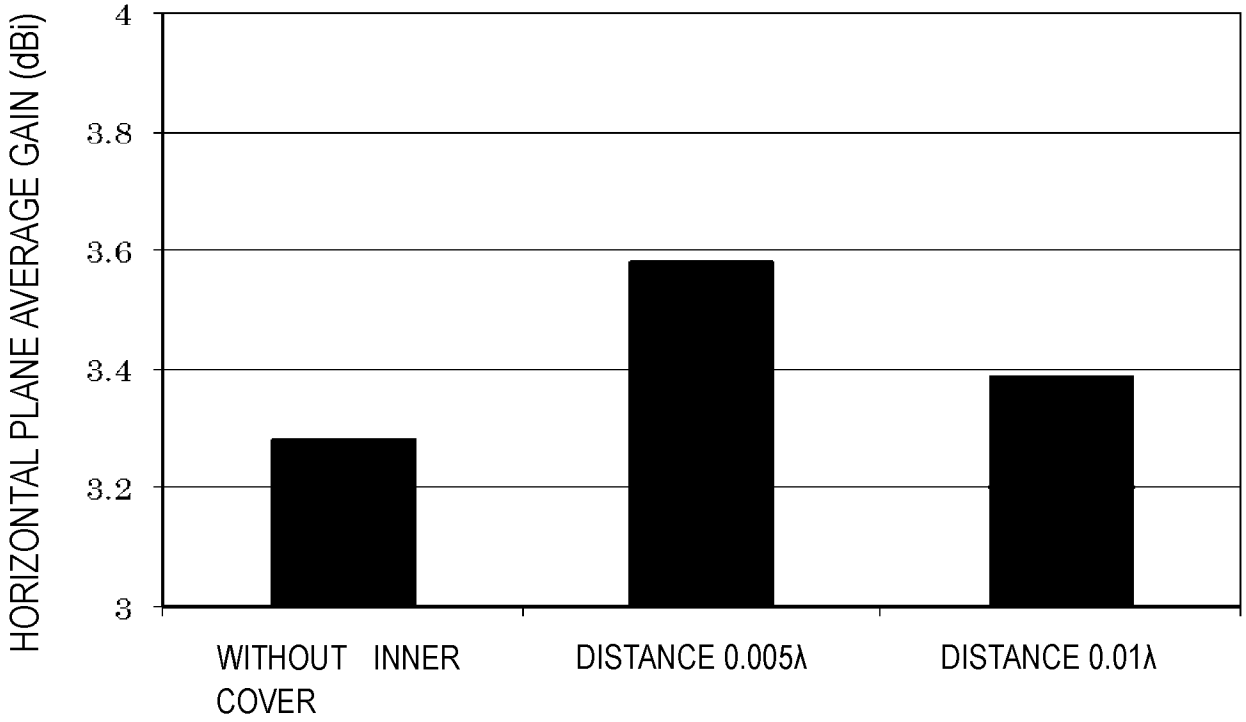
FIG. 8 is an explanatory diagram by simulation showing a relationship between a distance between the inner cover and the collinear array antenna and the horizontal plane average gain (here, the outer cover and the dielectric core are not present), according to the first embodiment.

FIG. 8 is an explanatory diagram by simulation showing a relationship between a distance between the inner cover 30 and the collinear array antenna 10 and the horizontal plane average gain. In this case, the simulation was performed assuming that the ground conductor plate 50 on the XY plane was horizontally arranged and the outer cover 20 and the dielectric core 40 were not present. Here, the distance is a clearance between the annular delay portion 13 of the collinear array antenna 10 and the inner cover 30, a distance of 0.005λ corresponds to about 0.25 mm, and a distance of 0.01λ corresponds to about 0.5 mm. As shown in FIG. 8, when the inner cover 30 is provided ("DISTANCE 0.005λ" and "DISTANCE 0.01λ"), the horizontal plane average gain is improved as compared to when the inner cover 30 is not provided ("WITHOUT INNER COVER"). The reason for this is that there is a premise that the collinear array antenna 10 is limited in the length in the Z-axis direction for the application for the vehicle and the sufficient length cannot be secured, but the shortage of the length of the collinear array antenna 10 can be compensated by the wavelength shortening effect due to a dielectric constant of the inner cover 30.

From FIG. 8, it can be easily estimated that the horizontal plane gain decreases as the distance between the inner cover 30 and the collinear array antenna 10 becomes larger than 0.01λ. Therefore, it is desirable to set the distance between the inner cover 30 and the collinear array antenna 10 to be equal to or less than 0.01λ (more preferably 0.005λ or less), so that the horizontal plane gain can be sufficiently improved. As seen from the result when the outer cover 20 is in close contact with the annular delay portion 13 in FIG. 6, it can be easily estimated that when the inner cover 30 is in close contact with the annular delay section 13 of the collinear array antenna 10, the horizontal plane average gain is lower than the horizontal plane average gain when the distance between the inner cover 30 and the collinear array antenna 10 is 0.005λ, but is improved as compared to the horizontal plane average gain when the collinear array antenna 10 is not covered with the inner cover 30.

Figure 9:
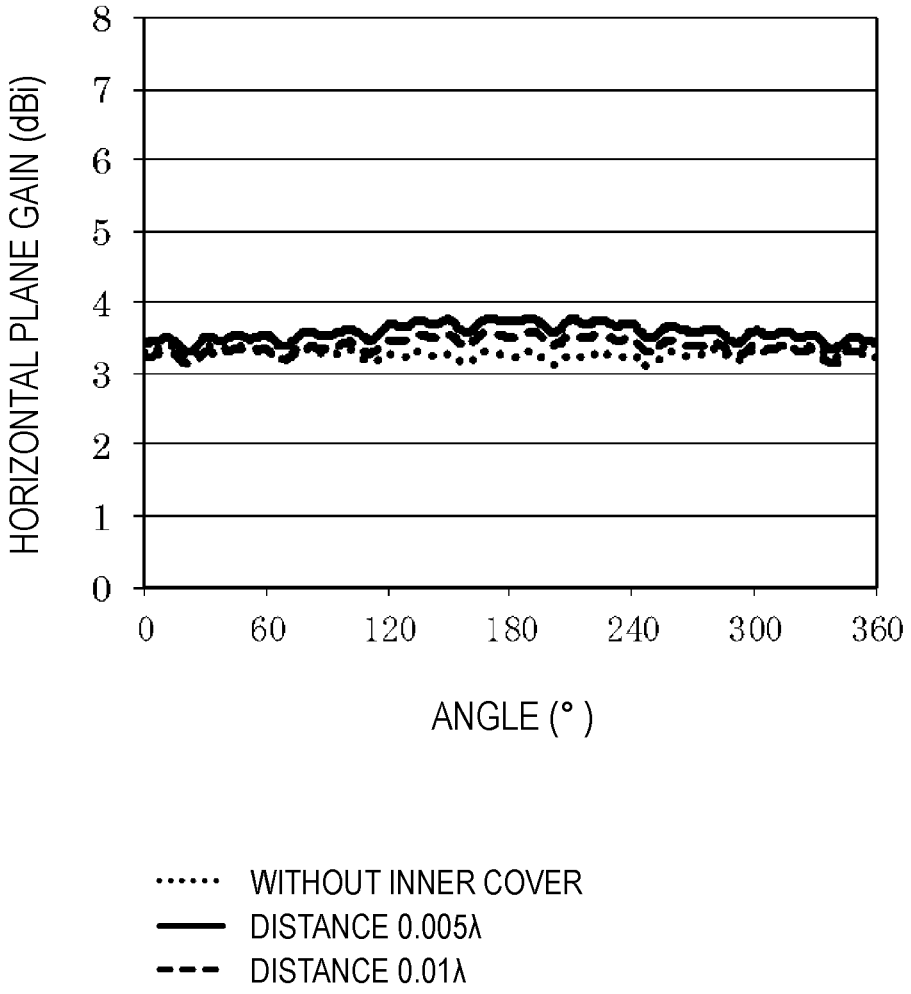
FIG. 9 is also a directional characteristic diagram by simulation showing a relationship between the directional angle and the horizontal plane gain (here, the outer cover or the dielectric core are not present).

FIG. 9 is a directional characteristic diagram by the simulation showing the relationship between the directional angle and the horizontal plane gain. The precondition of the simulation is the same as that in FIG. 8. In addition, the directional angle of 180° in FIG. 9 coincides with the X direction in FIG. 3. As shown in FIG. 9, the fluctuation of the horizontal plane gain accompanying the change in the directional angle when the collinear array antenna 10 is covered with the inner cover 30 ("DISTANCE 0.005" and "DISTANCE 0.01λ") is not significantly different from the fluctuation of the horizontal plane gain when the collinear array antenna 10 is not covered with the inner cover 30 ("WITHOUT INNER COVER"), and the non-directivity characteristic can be maintained even when the collinear array antenna 10 is covered with the inner cover 30.

Figure 10:
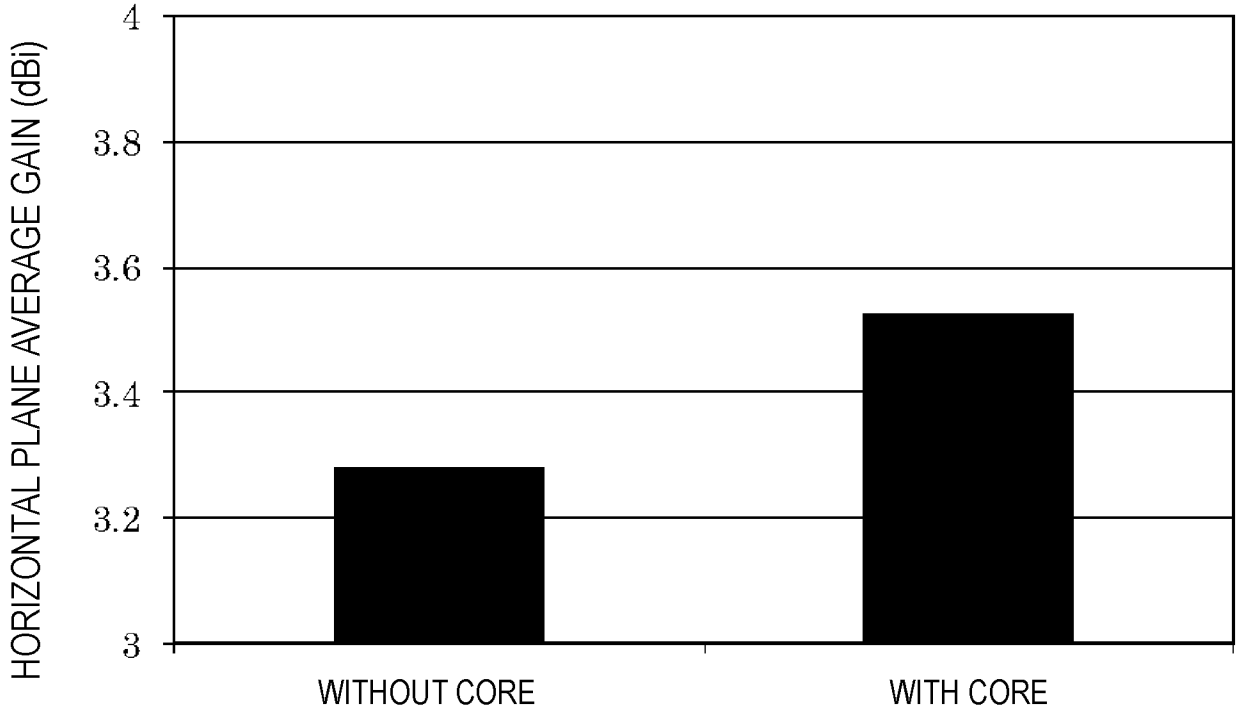
FIG. 10 is an explanatory diagram by simulation showing the horizontal plane average gain when the dielectric core is not provided and when the dielectric core is provided at the center of a delay portion (here, the outer cover and the inner cover are not present), according to the first embodiment.

FIG. 10 is an explanatory diagram by the simulation showing the horizontal plane average gain when the dielectric core 40 is not provided and when the dielectric core 40 is provided at the center of the annular delay portion 13. In FIG. 10, the simulation was performed assuming that the outer cover 20 and the inner cover 30 were not present. Also, in FIG. 10, a distance between the dielectric core 40 and the annular delay portion 13 when the dielectric core 40 is provided is set to 0.005λ. As shown in FIG. 10, when the dielectric core 40 is provided ("WITH CORE"), the horizontal plane average gain is improved as compared to the horizontal plane average gain when the dielectric core 40 is not provided ("WITHOUT CORE"). From the results of FIGS. 6 and 8 described above, it can be easily estimated that when the distance between the annular delay portion 13 and the dielectric core 40 is equal to or less than 0.005λ, the horizontal plane gain is higher than the horizontal plane average gain when the distance between the annular delay portion 13 and the dielectric core 40 is larger than 0.005λ. Therefore, it is preferable to set the distance between the annular delay portion 13 and the dielectric core 40 to be equal to or less than 0.005λ.

Figure 11:
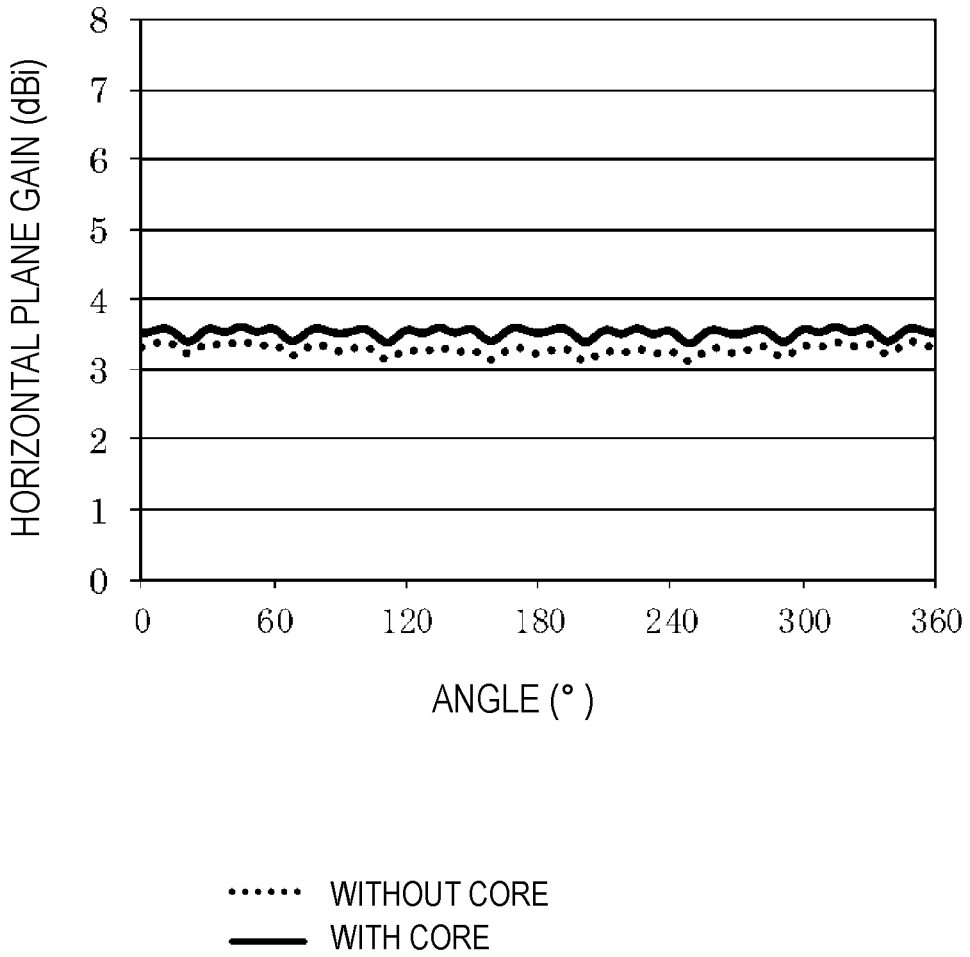
FIG. 11 is also a directional characteristic diagram by simulation showing the relationship between the directional angle and the horizontal plane gain (here, the outer cover and the inner cover are not present).

FIG. 11 is a directional characteristic diagram by the simulation showing the relationship between the directional angle and the horizontal plane gain. The precondition of the simulation is the same as those in FIG. 10. In addition, the directional angle of 180° in FIG. 11 coincides with the X direction in FIG. 3. As shown in FIG. 11, the fluctuation of the horizontal plane gain accompanying the change in the directional angle when the dielectric core 40 is provided ("WITH CORE") is not significantly different from the fluctuation of the horizontal plane gain when the dielectric core 40 is not provided ("WITHOUT CORE"), and the non-directivity characteristic can be maintained even when the dielectric core 40 is provided.

According to the present embodiment, the following effects can be obtained.

(1) By providing the dielectric outer cover 20 that in proximity covers the entire collinear array antenna 10 as the antenna element from the outside, the horizontal plane average gain of the antenna device 1 can be improved. In addition, the fluctuation in the horizontal plane gain accompanying the change in the directional angle is small, and the non-directivity characteristic can be substantially maintained. Further, the outer cover 20 can be used as the exterior case.

(2) By providing the dielectric inner cover 30 inside the outer cover 20 so as to proximity cover the first straight line portion 11 and the annular delay portion 13, the horizontal plane average gain of the antenna device 1 can be improved. In addition, the fluctuation in the horizontal plane gain accompanying the change in the directional angle is small, and the non-directivity characteristic can be substantially maintained.

(3) The outer cover 20 has the portion facing the first straight line portion 11 and the second straight line portion 12 of the collinear array antenna 10 substantially in parallel to the first straight line portion 11 and the second straight line portion 12, so that the wavelength shortening effect due to the dielectric constant of the outer cover 20 can be effectively used.

(4) By providing the dielectric core 40 positioned along the first straight line portion 11 and inside the annular delay portion 13, the horizontal plane average gain of the antenna device 1 can be improved. In addition, the fluctuation in the horizontal plane gain accompanying the change in the directional angle is small, and the non-directivity characteristic can be substantially maintained.

Second Embodiment

Figure 12:
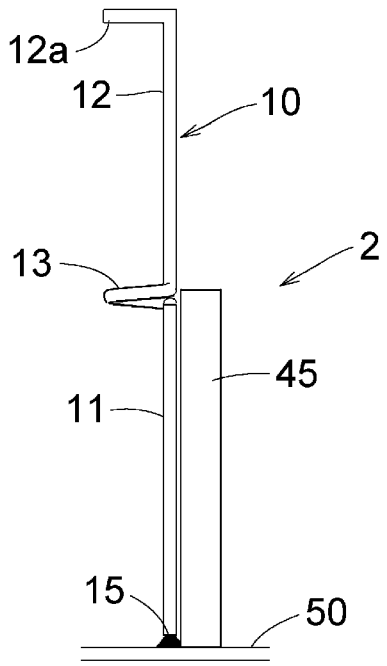
FIG. 12 is a front view showing an antenna device according to a second embodiment of the present invention, while omitting an outer cover and an inner cover.
Figure 13:
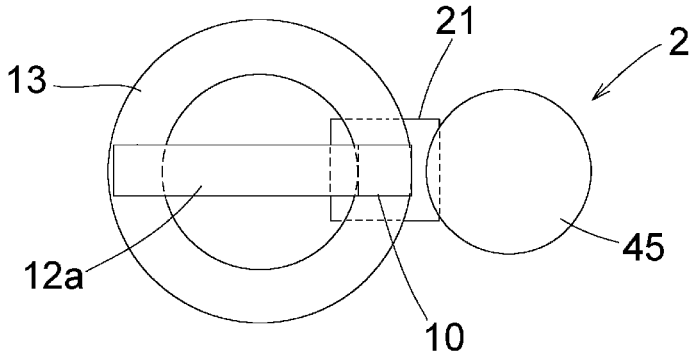
FIG. 13 is an enlarged plan view of the same.

FIG. 12 is a front view showing an antenna device 2 according to a second embodiment of the present invention while omitting the outer cover 20 and the inner cover 30, and FIG. 13 is an enlarged plan view thereof. In this case, a dielectric core 45 is a cylinder which has a length reaching the annular delay portion 13 from the lower end of the collinear array antenna 10, and is arranged along the first straight line portion 11 and outside of the annular delay portion 13 so as to be in non-contact with the annular delay portion 13. Other configurations are similar to those of the first embodiment described above.

Figure 14:
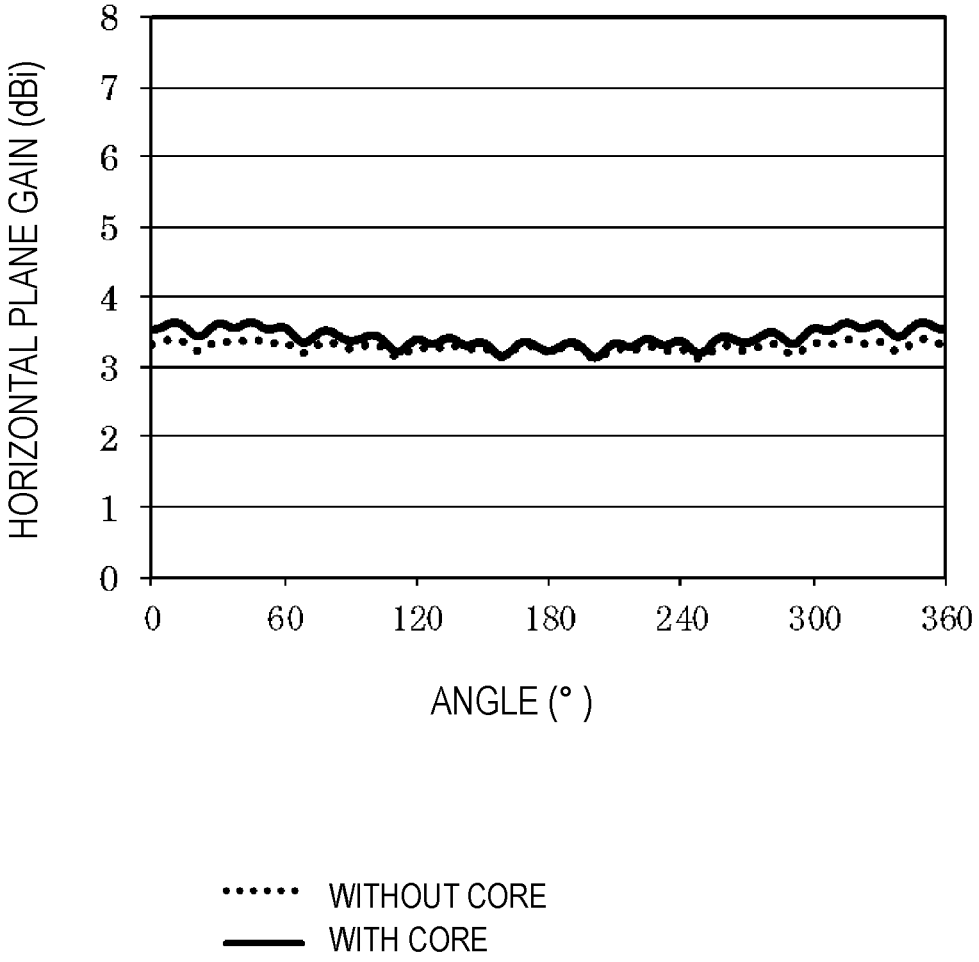
FIG. 14 is a directional characteristic diagram by simulation showing a relationship between a directional angle and a horizontal plane gain when a dielectric core is not provided and when the dielectric core is provided outside a delay portion (here, the outer cover and the inner cover are not present), according to the second embodiment.

FIG. 14 is a directional characteristic diagram by simulation showing a relationship between the directional angle and the horizontal plane gain when the dielectric core 45 is not provided and when the dielectric core 45 is provided. The simulation was performed assuming that the outer cover 20 and the inner cover 30 are not present. In FIG. 14, the horizontal plane average gain is 3.42 dBi when the dielectric core 45 is provided ("WITH CORE"), the horizontal plane average gain is 3.28 dBi when the dielectric core 45 is not provided ("WITHOUT CORE"), and therefore the horizontal plane average gain when the dielectric core 45 is provided is higher than the horizontal plane average gain when the dielectric core 45 is not provided. As shown in FIG. 14, even when the dielectric core 45 is provided outside the annular delay portion 13, there is no significant difference in the fluctuation of the horizontal plane gain accompanying the change in the directional angle as compared to that when the dielectric core 45 is not provided, and the omnidirectional property can be maintained.

Third Embodiment

Figure 15:
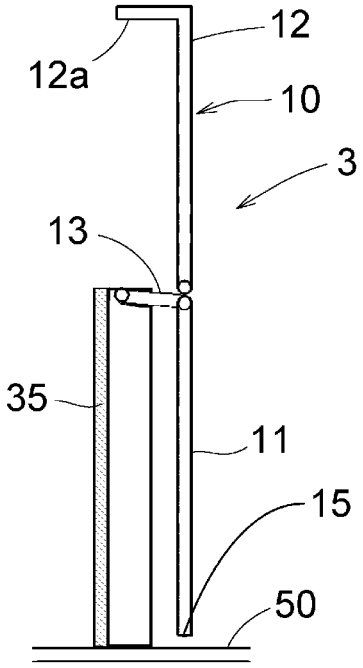
FIG. 15 is a front sectional view showing an antenna device according to a third embodiment of the present invention, while omitting an outer cover and a dielectric core.
Figure 16:
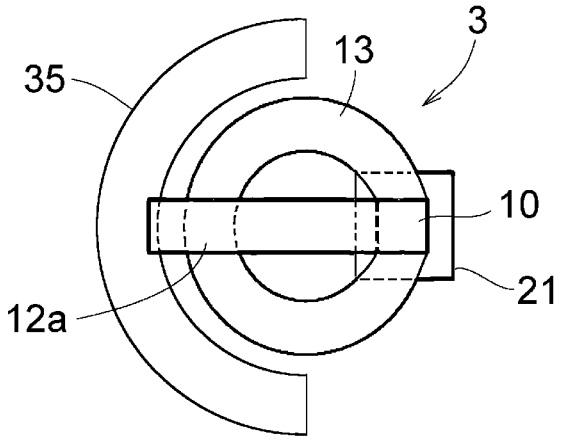
FIG. 16 is an enlarged plan view of the same.

FIG. 15 is a front view showing an antenna device 3 according to a third embodiment of the present invention while omitting the outer cover 20 and the dielectric core 40, and FIG. 16 is an enlarged plan view thereof. In this case, instead of the cylindrical inner cover 30 according to the first embodiment, a semi-cylindrical (semicircular arc) inner cover 35 is arranged so as to surround a half of a circumference of the annular delay portion 13 of the collinear array antenna 10. Other configurations are similar to those of the first embodiment described above.

Figure 17:
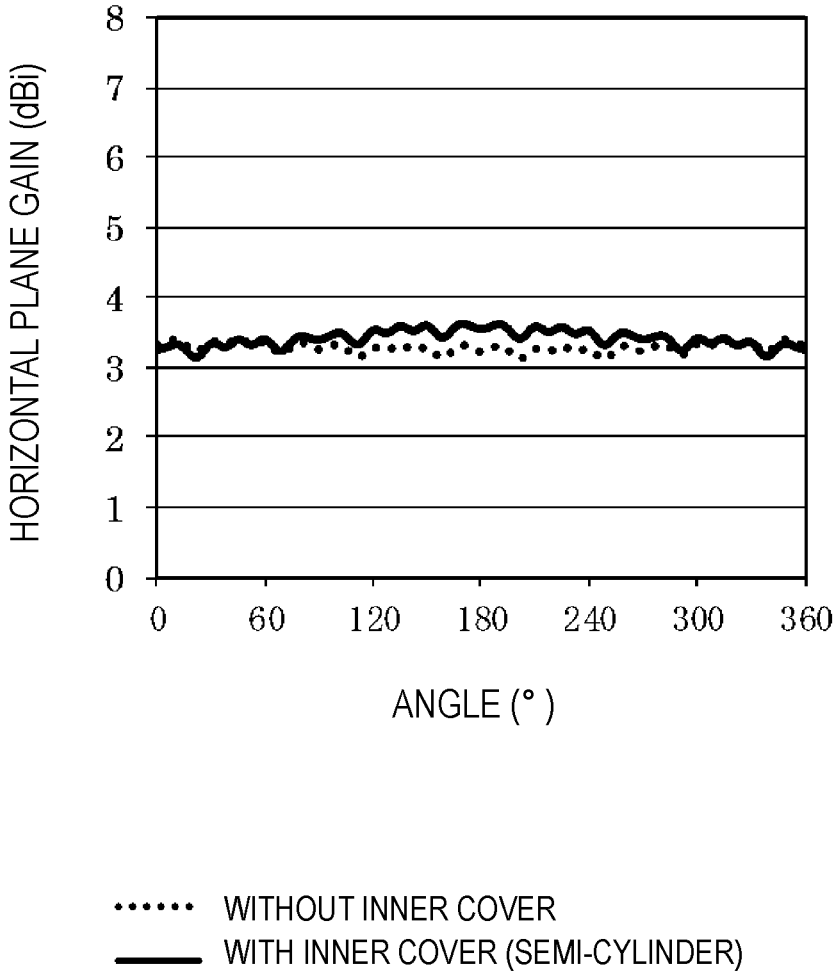
FIG. 17 is a directional characteristic diagram by simulation showing a relationship between a directional angle and a horizontal plane gain when a semi-cylindrical inner cover is not provided and when the semi-cylindrical inner cover is provided (here, the outer cover and the dielectric core are not present), according to the third embodiment.

FIG. 17 is a directional characteristic diagram by simulation showing a relationship between the directional angle and the horizontal plane gain when the semi-cylindrical inner cover 35 is not provided and when the semi-cylindrical inner cover 35 is provided. The simulation was performed assuming that the outer cover 20 and the dielectric core 40 are not present. In FIG. 17, the horizontal plane average gain is 3.42 dBi when the semi-cylindrical inner cover 35 is provided ("WITH INNER COVER (SEMI-CYLINDER)"), the horizontal plane average gain is 3.28 dBi when the semi-cylindrical inner cover 35 is not provided ("WITH- OUT INNER COVER"), and therefore the horizontal plane average gain when the semi-cylindrical inner cover 35 is provided is higher than the horizontal plane average gain when the semi-cylindrical inner cover 35 is not provided. In addition, even when the semi-cylindrical inner cover 35 is provided, there is no significant difference in the fluctuation of the horizontal plane gain accompanying the change in the directional angle, and the non-directivity characteristic can be maintained.

Fourth to Sixth Embodiments

Figure 18:
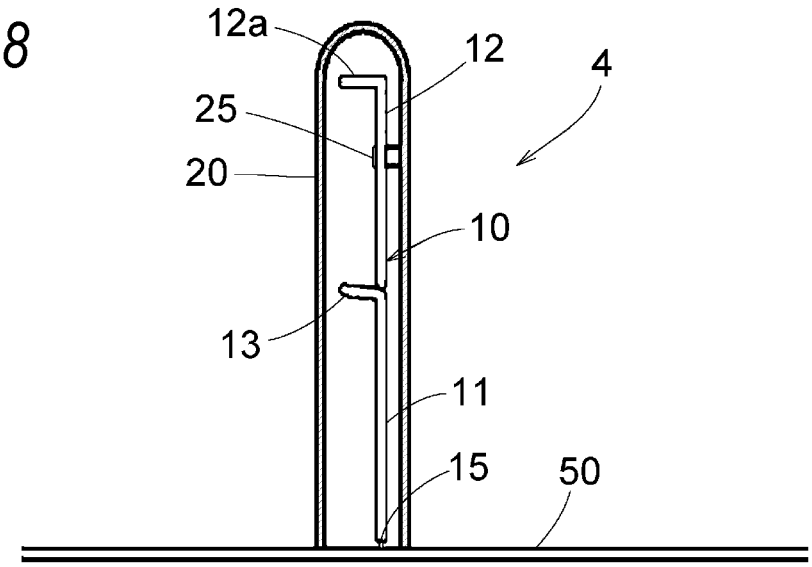
FIG. 18 is a front sectional view showing an antenna device according to a fourth embodiment of the present invention.
Figure 19:
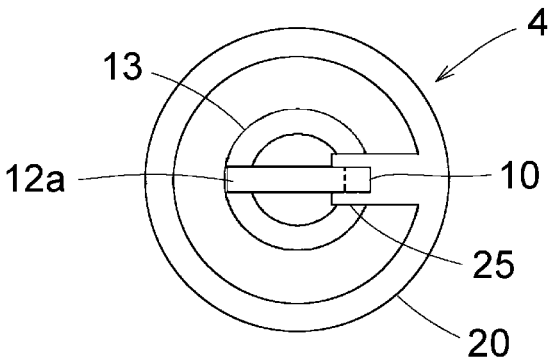
FIG. 19 is an enlarged plan sectional view of the same.
Figure 20:
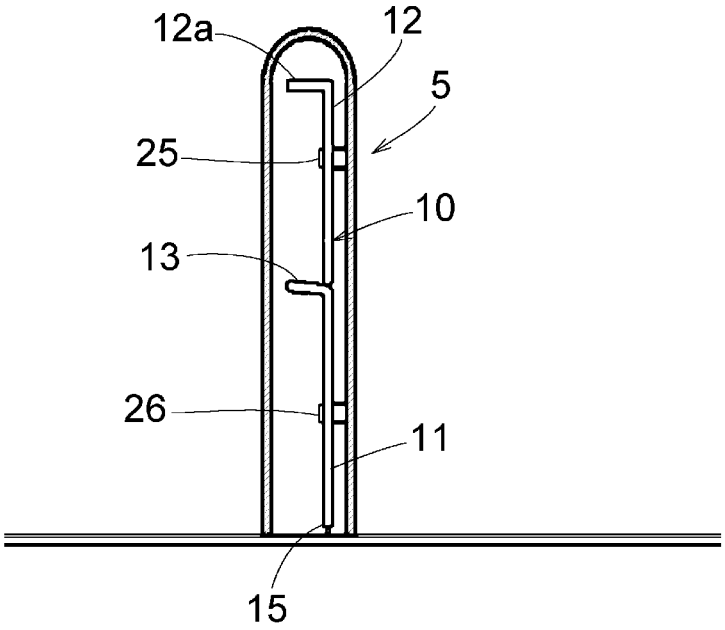
FIG. 20 is a front sectional view showing an antenna device according to a fifth embodiment of the present invention.
Figure 21:
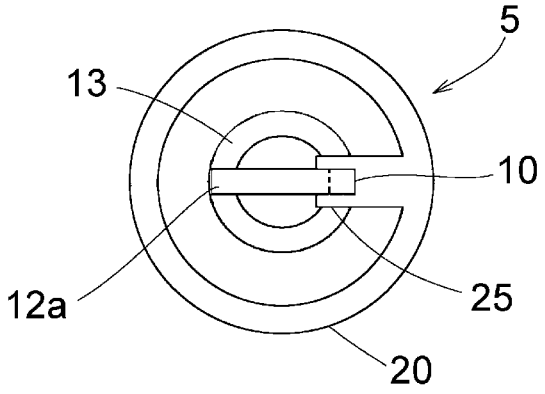
FIG. 21 is an enlarged plan sectional view of the same.
Figure 22:
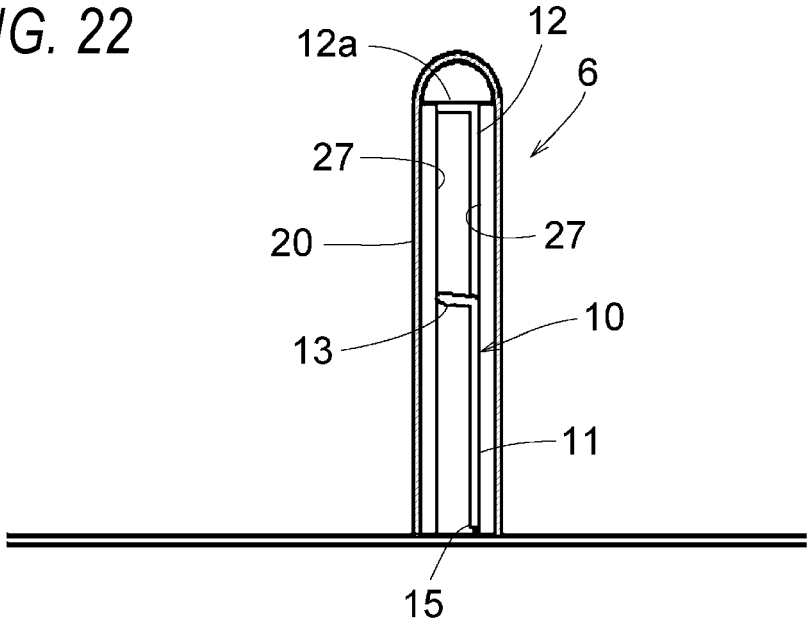
FIG. 22 is a front sectional view showing an antenna device according to a sixth embodiment of the present invention.
Figure 23:
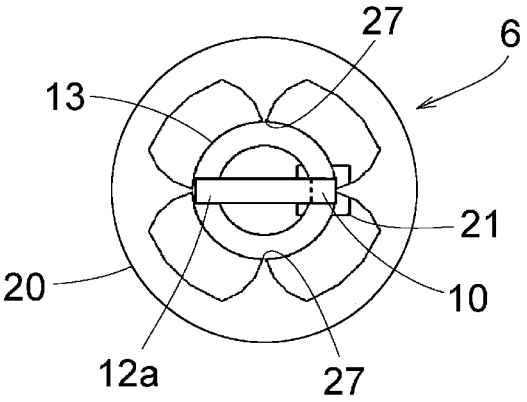
FIG. 23 is an enlarged plan sectional view of the same.

FIG. 18 is a front sectional view of an antenna device 4 according to a fourth embodiment of the present invention, and FIG. 19 is an enlarged plan sectional view thereof. FIG. 20 is a front sectional view of an antenna device 5 according to a fifth embodiment of the present invention, and FIG. 21 is an enlarged plan sectional view thereof. FIG. 22 is a front sectional view of an antenna device 6 according to a sixth embodiment of the present invention, and FIG. 23 is an enlarged plan sectional view thereof. Each of the fourth to sixth embodiments relates to a holding structure for the collinear array antenna 10. In the antenna device 4 according to the fourth embodiment, one support portion 25 supporting an upper portion of the collinear array antenna 10 is provided integrally with the outer cover 20 inside the outer cover 20. In the antenna device 5 according to the fifth embodiment, two support portions 25, 26 supporting the upper portion and a lower portion of the collinear array antenna 10 are provided integrally with the outer cover 20 inside the outer cover 20. In the antenna device 6 according to the sixth embodiment, a support portion 27 linearly supporting the collinear array antenna 10 from four directions is provided integrally with the outer cover 20 inside the outer cover 20. The fourth to sixth embodiments are the same as the structure in which the inner cover 30 and the dielectric core 40 are omitted in the first embodiment described above, except that each has the holding structure.

Figure 24:
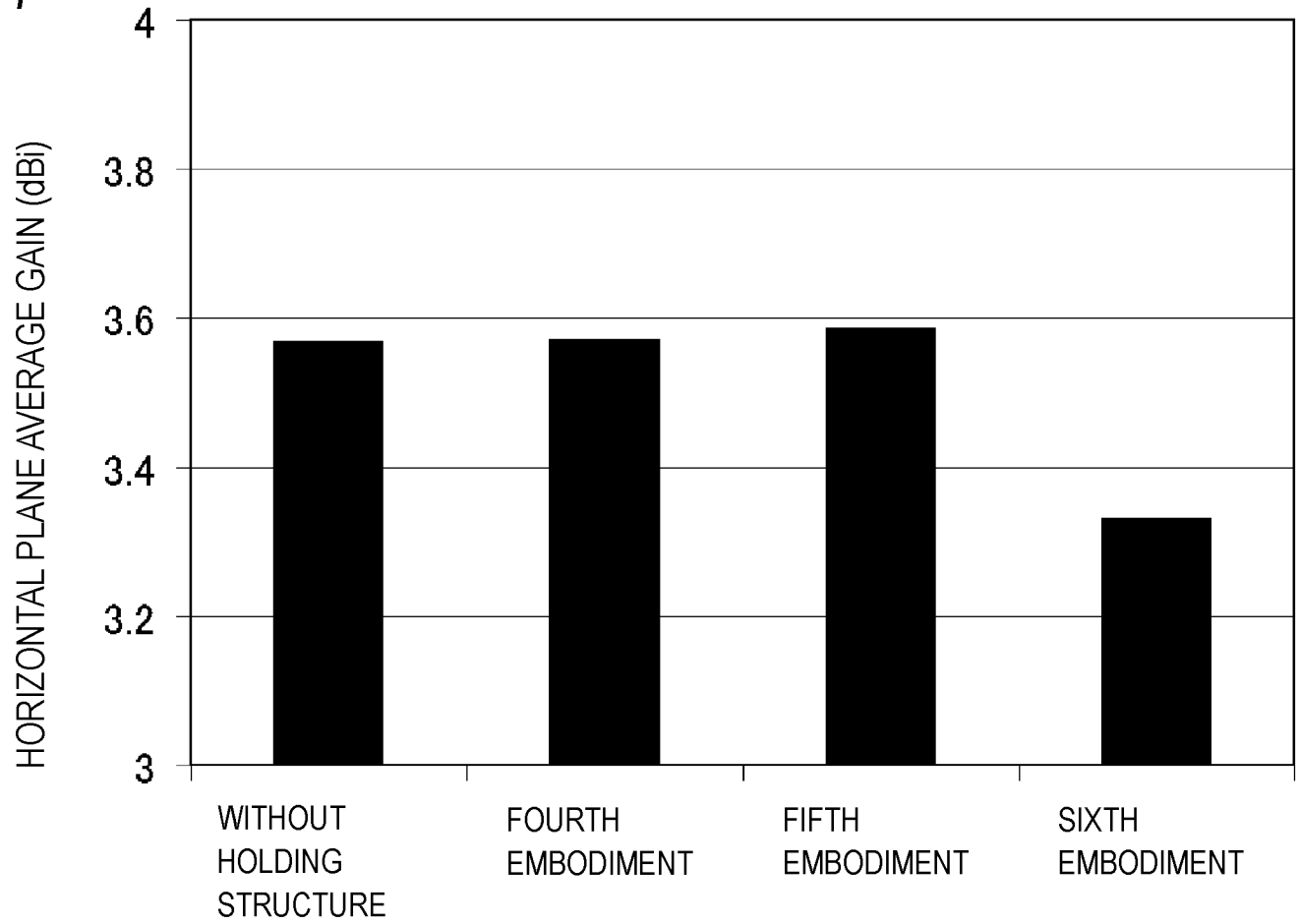
FIG. 24 is an explanatory diagram showing horizontal plane average gains in cases of fourth, fifth and sixth embodiments and in a case in which there is no holding structure for a collinear array antenna as an antenna element.

FIG. 24 is an explanatory diagram showing the horizontal plane average gain in cases of the fourth, fifth and sixth embodiments having the holding structure of the collinear array antenna 10 and in the case in which there is no holding structure of the collinear array antenna 10. In any cases, the distance between the annular delay portion 13 of the collinear array antenna 10 and the outer cover 20 is 0.02λ. In the fourth and fifth embodiments, the same horizontal plane average gain as that in the case in which there is no holding structure of the collinear array antenna can be ensured.

Although the present invention has been described above by taking the embodiments as an example, it will be understood by those skilled in the art that various modifications can be made to each component and each processing process of the embodiments within the scope of the claims. Hereinafter, a modification will be described.

The dielectric inner covers 30, 35 according to the first embodiment and the third embodiment of the present invention are arranged so as to cover the lower half of the collinear array antenna 10, but may be arranged so as to cover the upper half of the collinear array antenna 10, that is, the second straight line portion 12 from the annular delay portion 13. Similarly, the dielectric cores 40, 45 according to the first embodiment and the second embodiment are arranged with respect to the lower half of the collinear array antenna 10, but may be arranged on the upper half of the collinear array antenna 10, that is, from the annular delay portion 13 to the second straight line portion 12.

In the sixth embodiment of the present invention, the support portion 27 that linearly supports the collinear array antenna 10 from the four directions is provided inside the outer cover 20, but the support portion 27 may be configured to support the collinear array antenna 10 in three or more directions. The support portion 27 that linearly supports the collinear array antenna 10 from five or more directions may be provided inside the outer cover 20.

Figure 25A:
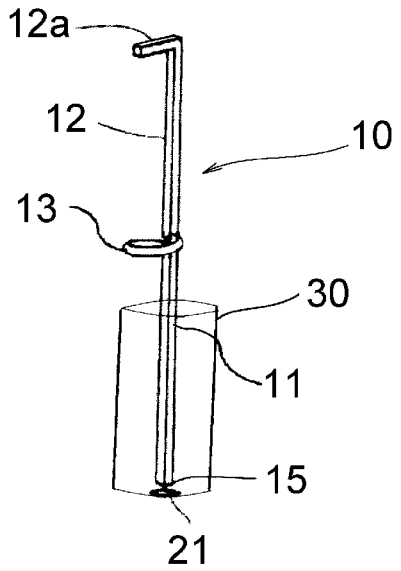
FIG. 25A is a perspective view showing a modification of the inner cover according to the first embodiment.
Figure 25B:
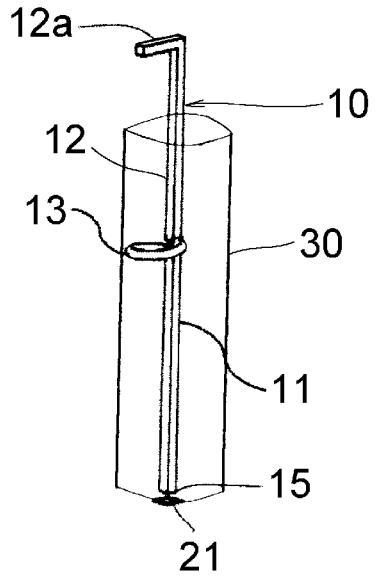
FIG. 25B is a perspective view showing another modification of the inner cover according to the first embodiment.

As shown in FIG. 4 of the first embodiment, the inner cover 30 covers to a region reaching the annular delay portion 13 from the lower end of the collinear array antenna 10 from the outside, but the embodiment is not limited thereto. For example, as shown in FIG. 25A, the inner cover 30 may cover to a region that does not reach the annular delay portion 13 from the lower end of the collinear array antenna 10 from the outside. Alternatively, as shown in FIG. 25B, the inner cover 30 may cover to a region beyond the annular delay portion 13 from the lower end of the collinear array antenna 10 from the outside. That is, the inner cover 30 covers at least a part of the collinear array antenna 10 from the outside, and has an opening at a side of an end portion of the collinear array antenna 10 opposite to the power feeding point 15. Then, the collinear array antenna 10 extends outside the opening.

Figure 26:
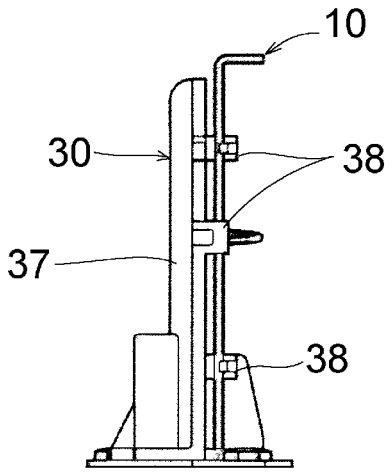
FIG. 26 is a perspective view showing further another modification of the inner cover according to the first embodiment.

In the first embodiment described above, such a case is explained that the inner cover 30 has a cylindrical shape and the cover 30 covers at least a part of the collinear array antenna 10 from the outside. However, the embodiment is not limited thereto. For example, the inner cover 30 may have a shape that overlaps a part of the collinear array antenna 10 in the vicinity of the collinear array antenna 10. More specifically, as shown in FIG. 26, the inner cover 30 has a columnar support portion 37 that overlaps the collinear array antenna 10 in one direction. In an example shown in FIG. 26, the support portion 37 overlaps the collinear array antenna 10 from a front side in a front-rear direction of the vehicle. In addition, the support portion 37 is provided with a fixing portion 38 holding the collinear array antenna 10. In the example shown in FIG. 26, a case where three fixing portions 38 are provided is shown. That is, the inner cover 30 overlaps with a part of the collinear array antenna 10 in the vicinity of the collinear array antenna 10 while holding the collinear array antenna 10 with the fixing portions 38. The inner cover 30 may be provided with the support portion 37 in a plurality of directions.

The embodiments described above can also be applied to a shark fin type antenna. In this case, an outer cover of the shark fin type antenna corresponds to the outer cover 20 shown in the embodiment.

REFERENCE SIGNS LIST

1 to 6 antenna device
10 collinear array antenna
11, 12 straight line portion
13 annular delay portion
15 power feeding point
20 outer cover
25, 26, 27 supporting portion
30, 35 inner cover
40, 45 dielectric core

The invention claimed is:

1. An antenna device comprising:

an antenna element for vertically polarized waves, including a first straight line portion of which one end serves as a power feeding point, and an annular portion of which one end is connected to another end of the first straight line portion; and a first dielectric cover covering the antenna element from outside; and a second dielectric cover covering the first straight line portion and the annular portion from outside, wherein the first dielectric cover covers the second dielectric cover.

2. The antenna device according to claim 1, wherein a distance between the antenna element and the second dielectric cover is equal to or less than 0.01 times a wavelength of a working frequency of the antenna element.

3. The antenna device according to claim 1, wherein the first dielectric cover has a portion facing the first straight line portion substantially in parallel.

4. The antenna device according to claim 1, wherein a distance between the antenna element and the first dielectric cover is equal to or less than 0.04 times a wavelength of a working frequency of the antenna element.

5. The antenna device according to claim 1, further comprising:

a dielectric core positioned along the first straight line portion and positioned inside or outside the annular portion.

6. The antenna device according to claim 1, wherein the antenna element is a collinear array antenna in which a second straight line portion is connected to another end of the annular portion and the annular portion serves as a delay portion.

7. The antenna device according to claim 6, wherein the second straight line portion includes a bent portion at an end portion opposite to one end connected to the annular portion.

8. An antenna device comprising:

an antenna element for vertically polarized waves, including a first straight line portion of which one end serves as a power feeding point, and an annular portion of which one end is connected to another end of the first straight line portion;

a third dielectric cover covering at least a part of the antenna element from outside, and having an opening at a side of an end portion of the antenna element opposite to the power feeding point, wherein the antenna element extends outside the opening.

9. The antenna device according to claim 8, wherein a distance between the antenna element and the third dielectric cover is equal to or less than 0.01 times a wavelength of a working frequency of the antenna element.

10. The antenna device according to claim 8, wherein the second straight line portion includes a bent portion at an end portion opposite to one end connected to the annular portion.

11. The antenna device according to claim 8, wherein the third dielectric cover has another opening at a side of the power feeding point.

12. An antenna device comprising:

an antenna element for vertically polarized waves, including a first straight line portion of which one end serves as a power feeding point, an annular portion of which one end is connected to another end of the first straight line portion, and a second straight line portion connected to another end of the annular portion; and a first dielectric cover covering the antenna element from outside, wherein the antenna element is a collinear array antenna in which the annular portion serves as a delay portion.

13. The antenna device according to claim 12, wherein the first dielectric cover has a portion facing the first straight line portion substantially in parallel.

14. The antenna device according to claim 12, wherein a distance between the antenna element and the first dielectric cover is equal to or less than 0.04 times a wavelength of a working frequency of the antenna element.

15. The antenna device according to claim 12, further comprising:

a dielectric core positioned along the first straight line portion and positioned inside or outside the annular portion.

16. The antenna device according to claim 12, wherein the second straight line portion includes a bent portion at an end portion opposite to one end connected to the annular portion.

17. The antenna device according to claim 12, further comprising:

a third dielectric cover covering at least a part of the antenna element from an outside, and having an opening at a side of an end portion of the antenna element opposite to the power feeding point, wherein the antenna element extends outside the opening.

18. The antenna device according to claim 17, wherein a distance between the antenna element and the third dielectric cover is equal to or less than 0.01 times a wavelength of a working frequency of the antenna element.

19. The antenna device according to claim 17, wherein the second straight line portion includes a bent portion at an end portion opposite to one end connected to the annular portion.

20. The antenna device according to claim 12, further comprising:

a third dielectric cover covering at least a part of the antenna element from an outside, and having an opening at a side of the power feeding point and another opening at a side of an end portion of the antenna element opposite to the power feeding point.

* * * * *